US005307970A

United States Patent [19]

Shibuya et al.

[11] Patent Number: 5,307,970

[45] Date of Patent: May 3, 1994

[54] PAPER WEB THREADING APPARATUS HAVING ABNORMALITY INDICATION ALARM

[75] Inventors: Kazuaki Shibuya, Tokyo; Kunio Suzuki, Kanagawa, both of Japan

[73] Assignee: Kabushiki Kaisha Tokyo Kikai Seisakusho, Tokyo, Japan

[21] Appl. No.: 981,991

[22] Filed: Nov. 24, 1992

Related U.S. Application Data

[63] Continuation of Ser. No. 805,749, Dec. 12, 1991, abandoned.

[30] Foreign Application Priority Data

Dec. 13, 1990 [JP] Japan ..... 2-410096

[51] Int. Cl.[5] ..... B41F 13/02; B65H 23/18

[52] U.S. Cl. ..... 226/92; 101/228; 400/613.1

[58] Field of Search ..... 226/91, 92; 101/228; 400/613.1

[56] References Cited

U.S. PATENT DOCUMENTS

| | | | |
|---|---|---|---|
| 3,761,001 | 9/1973 | Bolza-Schunemann et al. | 226/92 |
| 3,995,553 | 12/1976 | Winterholler et al. | 101/228 |
| 4,063,505 | 12/1977 | Sasamoto et al. | 101/228 |
| 4,111,122 | 9/1978 | Kutzner et al. | 101/228 |
| 4,308,798 | 1/1982 | Carlton | 101/426 |
| 4,370,927 | 2/1983 | Fischer | 101/228 |
| 4,404,907 | 9/1983 | Köbler et al. | 101/228 |
| 4,555,096 | 11/1985 | Uchiyama | 226/91 X |
| 4,676,445 | 6/1987 | Itakawa | 226/91 X |
| 4,686,778 | 8/1987 | Kotitschke et al. | 226/91 X |
| 4,706,862 | 11/1987 | Theilacker | 226/92 |
| 4,747,254 | 5/1988 | Lancaster | 226/92 X |
| 4,819,557 | 4/1989 | Handschuher | 101/228 |
| 4,840,320 | 6/1989 | Shigeta et al. | 226/91 X |
| 4,869,834 | 9/1989 | Hudson | 100/196 X |
| 4,904,344 | 2/1990 | Peiffer | 162/193 |
| 4,987,830 | 1/1991 | Fukuda et al. | 101/228 |
| 5,003,889 | 4/1991 | Glunz et al. | 101/228 |
| 5,029,742 | 7/1991 | Theilacker et al. | 226/92 |
| 5,052,295 | 10/1991 | Suzuki et al. | 101/228 |
| 5,119,725 | 6/1992 | Okamura | 226/91 X |

*Primary Examiner*—Daniel P. Stodola
*Assistant Examiner*—Paul T. Bowen
*Attorney, Agent, or Firm*—Armstrong, Westerman, Hattori, McLeland & Naughton

[57] ABSTRACT

A paper web threading apparatus for use in a paper web processing machine which aims at threading a paper web along a paper web threading path by moving a paper web threading member to which the paper web is secured along a guide member provided along the path, and which comprises detectors for detecting the paper web threading member which is moved along the guide member and outputting a detection signal; and an abnormality indication signal outputting device for outputting an abnormality indication signal when the detection signal is not outputted within a predetermined period of time during the movement of the paper web threading member.

10 Claims, 9 Drawing Sheets

$S_0$ ···· PEPER WEB THREADING MEMBER DRIVE SIGNAL
$S_1$ ···· SIGNAL INDICATIVE OF THE PRESENCE OF PAPER WEB THREADING MEMBER
$S_2$ ···· TIMER SIGNAL
$S_3$ ···· GUIDE PIECE DETECTION SIGNAL
$S_4$ ···· ABNORMALITY INDICATION SIGNAL
• ···· RESETTING OF TIMER SIGNAL $S_0$ ....PEPER WEB THREADING MEMBER DRIVE SIGNAL
$S_1$ ....SIGNAL INDICATIVE OF THE PRESENCE OF PAPER WEB THREADING MEMBER
$S_2$ ....TIMER SIGNAL
$S_3$ ....GUIDE PIECE DETECTION SIGNAL
$S_4$ ....ABNORMALITY INDICATION SIGNAL
•....RESETTING OF TIMER SIGNAL
t....PREDETERMINED LIMIT TIME

PAPER WEB THREADING APPARATUS HAVING ABNORMALITY INDICATION ALARM

This application is a continuation of application Ser. No. 07/805,749 filed Dec. 12, 1991, now abandoned.

BACKGROUND OF THE INVENTION

1. Field of the Invention

This invention relates to a paper web threading apparatus for threading a paper web through a paper web processing or handling machine such as, for example, a rotary printing press, and more particularly to a paper web threading apparatus for threading a paper web through a paper web threading path in the machine by moving a paper web threading member of non-endless type to which the paper web is secured on and along a guide member provided along the path.

2. Description of the Prior Art

Prior art apparatuses for threading a paper web through a paper web threading path in a paper web processing machine by moving a paper web threading member to which the paper web is secured along a guide member provided along the path are disclosed, for example, in Japanese Patent Publication No. HEI-2-30978, Japanese Laid-Open Patent Application No. HEI-2-80249 and Federal Republic of Germany Patent No. 22 41 127, etc.

In the paper web threading apparatuses shown in these publications, guide members are provided along paper web threading paths extending from paper supply sections of a rotary printing press which is a paper web processing machine through printing sections to folding sections, and paper web threading members are arranged to run on and along the guide members, and each of the guide members being partially cut away at appropriate places to install driving means for moving the paper web threading member thereon. And, a paper web retaining member connected to the paper web threading member at an appropriate place thereof is projected to the side of the paper web threading path, and a paper web is secured to the paper web retaining member. The arrangement is made such that when the paper web threading member is driven by the driving means so as to move along the guide member with one end thereof located at the leading end thereof the paper web can be threaded through a predetermined paper web threading path.

In the above-mentioned paper web threading apparatuses, to achieve stable movement of the paper web threading member along the guide member, it is necessary for the paper web threading member to have such a degree of rigidity as it is not bent by a frictional resistance between itself and the guide member. Further, since the paper web threading paths in the paper web processing machine are usually bent in complicated manner and the curves of the paths have relatively small diameters, the guide members provided along such paper web threading paths are also formed to be bent at relatively small diameters. Therefore, to achieve stable movement of the paper web threading member along the guide member, it is necessary for the paper web threading member to possess such a degree of flexibility as it may be bent in accordance with the bends of the guide member. Therefore, paper web threading members are formed so as to possess the above-mentioned two characteristic properties.

Whilst, in the above-mentioned paper web threading apparatuses, in case, for example, a foreign matter intrudes into the guide member or a foreign matter is left on or near the guide member for some reason, it impedes the movement of the paper web threading member along the guide member and sometimes stops the paper web threading member. However, since the paper web threading member is driven by driver means so as to be sent out from behind, even when the movement of the paper web threading member is stopped, the driver means still functions to send out or forward the portion of the paper web threading member behind the position where it is stopped.

As a result, in case the paper web threading member is relatively flexible, it is bent or deformed inside the guide member between the position where it is stopped and the driving means, and is damaged finally, and further the guide member is deformed or damaged, or in case the paper web threading member is relatively rigid, the driving means is subjected to an overloading and damaged sometimes.

SUMMARY OF THE INVENTION

The present invention has for its object to provide a paper web threading apparatus for threading a paper web through a paper web processing machine by moving a paper web threading member on and along a guide member provided along a paper web threading path, wherein when the paper web threading member is stopped during the paper web threading operation, this condition is detected in the form of an abnormality indication signal so as to prevent the paper web threading apparatus from being deformed or damaged and to enable the restoration of operation of the paper web threading apparatus to be made readily and in a short time.

To achieve the above-mentioned object, according to a first aspect of the present invention, there is provided a paper web threading apparatus for use in a paper web processing machine wherein a guide member is provided along a paper web threading path, and a paper web threading member to which a paper web is secured is moved along the guide member so as to thread the paper web through the paper web threading path, the apparatus comprising: detecting means for detecting the paper web threading member which is moved along the guide member and outputting a detection signal, and abnormality indication signal outputting means for outputting an abnormality indication signal when the detection signal is not outputted from the detecting means within a predetermined period of time during the movement of the paper web threading member.

According to a second aspect of the present invention, there is provided a paper web threading apparatus for use in a paper web processing machine as set forth in the first aspect wherein the paper web threading member has at least one portion to be detected provided thereon, and the portion to be detected is detected by means of the detecting means.

According to a third aspect of the present invention, there is provided a paper web threading apparatus for use in a paper web processing machine as set forth in the first aspect wherein one portion to be detected provided on the paper web threading member is detected at a plurality of detection places arranged at intervals of a predetermined distance along the guide member.

According to a fourth aspect of the present invention, there is provided a paper web threading apparatus for use in a paper web processing machine as set forth in the first aspect, wherein the paper web threading member has a plurality of portions to be detected provided at intervals of a predetermined distance in the longitudinal direction thereof, and these portions to be detected are detected at one detection place disposed in the vicinity of the guide member.

According to a fifth aspect of the present invention, there is provided a paper web threading apparatus for use in a paper web processing machine as set forth in the first aspect, wherein the paper web threading member has a plurality of portions to be detected provided at intervals of a predetermined distance in the longitudinal direction thereof, and these portions to be detected are detected at a plurality of detection places disposed at intervals of a predetermined distance along the guide member, and also an abnormality indication signal is outputted when the detection signal from either one of the detection places is not outputted within a predetermined period of time.

According to a sixth aspect of the present invention, there is provided a paper web threading apparatus for use in a paper web processing machine as set forth in the fourth aspect or the fifth aspect, wherein paper web threading member detecting means capable of detecting the paper web threading member proper movable on and along the guide member is (are) provided at the detection place (places) for detecting the portions to be detected provided on the paper web threading member, and only at the detection place where the paper web threading member detecting means is detecting the paper web threading member, the abnormality indication signal outputting means is rendered operative.

In each of the above-mentioned paper web threading apparatuses, for the purpose of threading a paper web through a predetermined paper web threading path or making preparations for paper web threading operation, the paper web threading member is driven by driving means so as to move along the guide member. This speed of movement is nearly in proportion to the operating speed of the driving means. In each of the paper web threading apparatuses, the following operation is made.

In the paper web threading apparatus according to the first aspect of the present invention, the paper web threading member which is moved on and along the guide member is detected at appropriate detection places along the guide member. When the paper web threading member is detected at each of the detection places, the corresponding detecting means outputs a detection signal. The time required for the paper web threading member to move to a particular detection place along the guide member depends on the speed of movement thereof, that is, the operating speed of the driving means which is nearly proportional to the speed of movement of the paper web threading member. A reference time is preset on the basis of the predetermined fixed time, and when the detection signal is not outputted within the reference period of time, the abnormality indication signal outputting means will discriminate it as abnormal condition occuring in the movement of the paper web threading member and output an abnormality indication signal.

In the paper web threading apparatus according to a second aspect, the paper web threading member has at least one portion to be detected provided thereon, and the portion to be detected is detected by means of the detecting means during the movement thereof along the guide member.

In the paper web threading apparatus according to third aspect, one portion to be detected provided on the paper web threading member, such as, for example, one end of the paper web threading member which is moved along the guide or a predetermined mark thereon or the like is detected at a plurality of detection places along the guide member. Each time the portion to be detected is detected at each of the detection places, the detecting means for detecting the portion to be detected will output a detection signal. The time required for the paper web threading member to move over the distance between the adjacent detection places along the guide member depends on the operating speed of the driving means, as in the case of the aforementioned embodiment. A reference time is preset on the basis of the predetermined fixed time, and when the next detection signal is not outputted within the reference period of time after the previous detection signal is outputted, the abnormality indication signal outputting means will discriminate it as abnormal condition occuring in the movement of the paper web threading member and output an abnormality indication signal, as in the case of the above-mentioned embodiments.

In the paper web threading apparatus according to the fourth aspect, the plurality of portions to be detected provided on the paper web threading member which is moved along the guide member are detected at only one detection place, such as, for example, the most upstream side detection place when preparations for threading a paper web through a predetermined path are made. Each time when each of the portions to be detected is detected at the detection place, the detecting means will output a detection signal. The time needed for the paper web threading member to move over the distance corresponding to the space between the longitudinally adjacent portions to be detected depends on the operational speed of the driving means, as in the case of the above-mentioned embodiments. A reference time is preset on the basis of the predetermined fixed time, and when the next detection signal is not outputted within the reference period of time after the previous detection signal is outputted, the abnormality indication signal outputting means will discriminate it as abnormal condition occuring in the movement of the paper web threading member and output an abnormality indication signal, as in the case of the aforementioned embodiments.

In the paper web threading apparatus according to the fifth aspect, the plurality of portions to be detected provided on the paper web threading member which is moved along the guide member are detected at the plurality of detection places along the guide member. Each time each of the portions to be detected is detected at each of the detection places, the corresponding detecting means for detecting the portions to be detected will output a detection signal. The time required for the paper web threading member to move over the distance between the longitudinally adjacent portions to be detected depends on the operating speed of the driving means, as in the case of the aforementioned embodiments. A reference time is preset on the basis of the predetermined fixed time, and when the next detection signal is not outputted within the reference period of time after the previous detection signal is outputted, the abnormality indication signal outputting means will discriminate it as abnormal condition occuring in the movement of the paper web threading member and output an abnormality indication signal.

In the paper web threading apparatus according to the sixth aspect, when the paper web threading member which is moved along the guide member has passed through each of the detection places, the paper web threading member itself is detected by each of the paper web threading member detecting means provided at each of the detection places. In addition thereto, only at the detection place where the detecting means is detecting the paper web threading member, the abnormality indication signal outputting means is rendered operative to output an abnormality indication signal if the next detection signal is not outputted in the predetermined period of time after the previous detection signal is outputted, in the same manner as in the apparatus according to the fourth aspect or the fifth aspect.

By applying the present invention to the paper web threading apparatus for threading a paper web through a paper web processing machine by moving a paper web threading member along guide member provided along a paper web threading path, when the paper web threading member is stopped for some reasons during its movement for the purpose of threading the paper web through a predetermined path or making preparations for paper web threading operation, it is possible to detect the stoppage and prevent the paper web threading apparatus from being deformed and damaged, with the result that the restoration of operation of the paper web threading apparatus can be made readily and in a short time.

Therefore, the present invention is very effective for improving the efficiency of paper web threading operation.

The above-mentioned and other objects, aspects and advantages of the present invention will become apparent to those skilled in the art by making reference to the following description and the accompanying drawings in which preferred embodiments incorporating the principles of the present invention are shown by way of example only.

DETAILED DESCRIPTION OF THE PREFERRED EMBODIMENTS

The present invention will now be described in detail below by way of several embodiments with reference to the accompanying drawings.

This paper web processing machine has a plurality of paper web threading paths which extend from paper web supply sections to final processing sections and which are each routed by a plurality of guide rollers GR and turning bars TB or drag rollers DR, etc.

Figure 1:
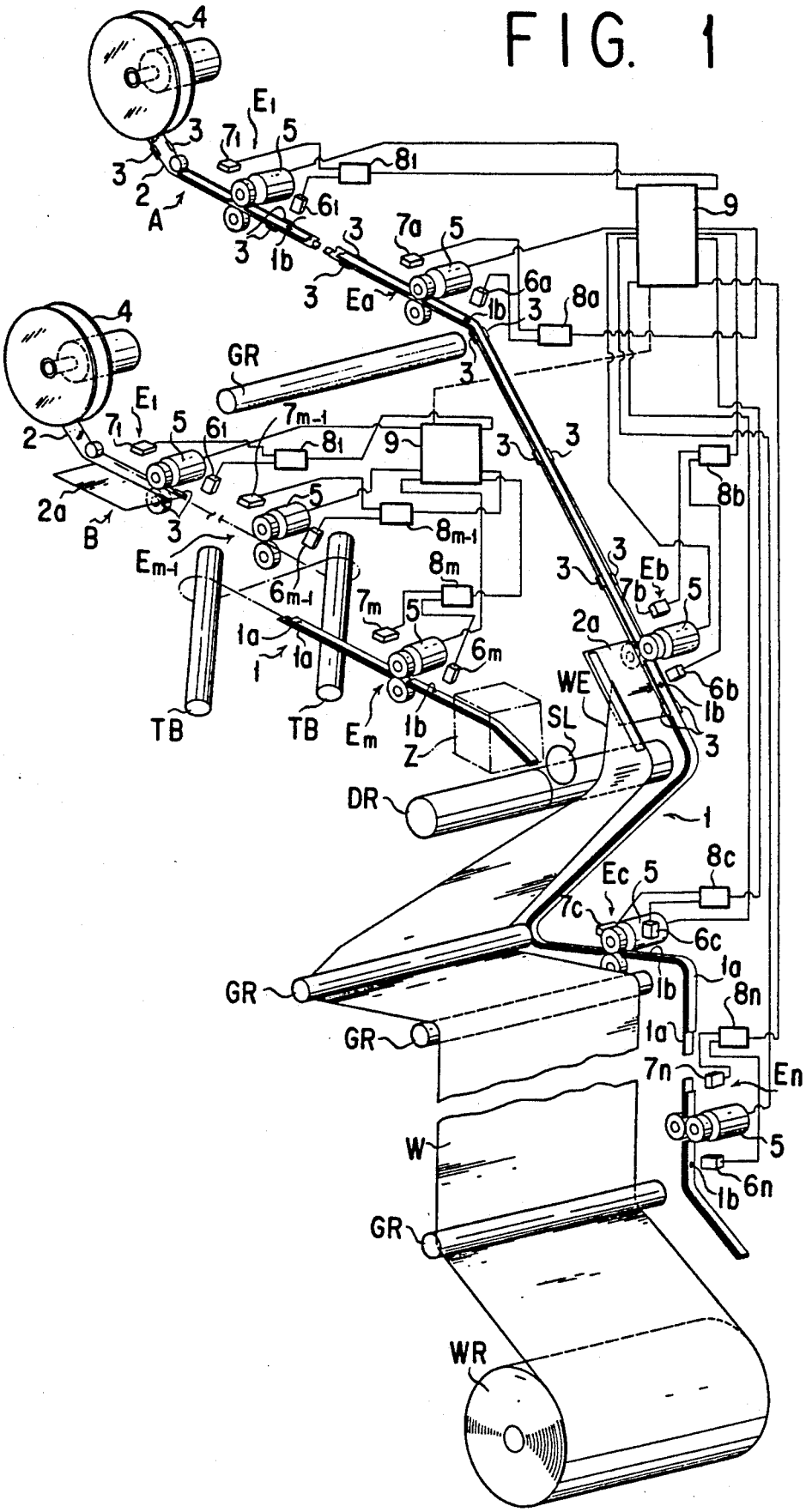
FIG. 1 is a schematic overall configurational view showing one embodiment of the present invention.

In such a paper web processing machine, the paper web threading apparatus is arranged to draw out a paper web W from a paper web take-up reel WR mounted at a paper web supply section and thread it through a predetermined or preselected paper web threading path to handle or process it as desired, and one embodiment thereof is shown in FIG. 1.

That is to say; on one side of the above-mentioned paper web threading path, and also on the inside of a frame (not shown) of the paper web processing machine, guide members 1, each adapted to guide a paper web threading member 2 of non-endless type, extend from the paper web supply sections to the final processing sections, and are fixedly secured to the frame by means of suitable brackets (not shown). The guide member 1 is constituted by two rail members 1*a*, 1*a* which are located in spaced-apart and opposed relationship. The spacing or clearance defined between the rail members 1*a*, 1*a* is slightly more than the thickness of the paper web threading member 2 so that the latter may be slidably inserted longitudinally within the clearance.

The paper web threading member 2 is a belt-shaped, flexible member which is deformable according to bends of the guide member 1, and which has guide pieces 3, 3—(serving as "the portions to be detected" which will be described later) mounted on widthwise both sides thereof and at substantially at regular intervals in the longitudinal direction thereof in such a way as to be held in sliding contact with both sides of the guide member 1.

Further, the paper web threading member 2 is provided with a paper web retaining member 2*a* at one end thereof for retaining the paper web W when it is threaded along a paper web threading path. And, the other end of the paper web threading member 2 is connected to a paper web threading member pooling section 4 installed at an appropriate position on the side of the final processing section.

The guide member 1 is cut away or notched at proper places where driving means 5, 5—are provided to hold the paper web threading member 2 between them and rotate to move it. Further, branching members and joining members (which are not shown) are installed on the way of the guide member 1 so that a desired paper web threading path can be selected properly to thread a paper web along it.

Further, proper positions along the guiding member 1 such as, for example, positions near the driving means 5, 5—are set as detection places $E_1$, Ea, Eb, Ec—Em-1, Em—En, at each of which, a means for monitoring the movement of the paper web threading member 2 is provided. The means for monitoring the movement of the paper web threading member 2 comprises any one of paper web threading member detecting means $6_1$, *6a*, *6b*, *6c*—*6m*-1, *6m*—*6n* installed at the detection places $E_1$—En, respectively. Any one of guide piece detecting means $7_1$, *7a*, *7b*, *7c*—*7m*-1, *7m*—*7n*, and any one of abnormality indication signal outputting means $8_1$, *8a*, *8b*, *8c*—*8m*-1, *8m*—*8n* connected therewith.

Each of the paper web threading member detecting means $6_1$—*6n* is rendered operative by a paper web threading member drive signal $S_0$ (Refer to FIGS. 2 to 5) which actuates the driving means 5, 5—, and detects the paper web threading member 2, which is moved on and along the guiding member 1, through each of holes 1*b* formed in the rail members 1*a* and outputs a signal $S_1$ indicative of the presence of paper web threading member. (Refer to FIGS. 2 to 5). Each of the guide piece detecting means $7_1$—*7n* is rendered operative only while the signal $S_1$ indicative of the presence of paper web threading member is outputted, and detects the guide pieces 3, 3—of the paper web threading member 2, which is moved on and along the guide member 1, and outputs a guide piece detection signal $S_3$. (refer to FIGS. 2 to 5). Each of the abnormality indication signal outputting means $8_1$—*8n* has a timer unit, not shown, and is rendered operative only while the signal $S_1$ indicative of the presence of paper web threading member is outputted, in the same manner as that in the guide piece detecting means $7_1$—*7n*. When each of the abnormality indication signal outputting means $8_1$—*8n* is rendered operative, it will transmit a timer signal $S_2$. (refer to FIGS. 2 to 5). Upon receipt of the timer signal $S_2$, the timer unit (not shown) will conduct its time counting. The timer unit is reset by a guide piece detection signal $S_3$.

The operation of the above-mentioned arrangement is as follows.

First of all, a drive controlling means 9 is rendered operative to transmit a paper web threading member drive signal $S_0$ so as to rotate the driving means 5, 5—reversely to move the paper web threading member 2 inserted in the guiding member 1 from the paper web threading member pooling section 4 back to the paper web supply section where a paper web W stands by, and when the paper web retaining member 2*a* has been moved to a predetermined position in the vicinity of the paper web stand-by position, the transmission of the paper web threading member drive signal $S_0$ by the drive controlling means 9 is cut off, thereby stopping the driving means 5, 5—to stop the movement of the paper web threading member 2.

Subsequently, the end WE of the paper web W is secured to the paper web retaining member 2*a*.

This paper web securing operation is made either manually or automatically using an adhesive-bonding means (not shown). Upon completion of this securing operation, the paper web threading apparatus is ready for threading of the paper web through the relevant paper web threading path.

In conducting paper web threading operation from the condition wherein the preparation for threading the paper web is completed, the drive controlling means 9 is rendered operative again to transmit a paper web threading member drive signal $S_0$ so as to rotate the driving means, 5, 5—forward to move the paper web threading member 2 in the reverse direction to that of movement of the paper web when the preparations for threading the paper web are made, that is, towards the final processing section. As a result, the paper web W secured to the paper web retaining member 2*a* of the paper web threading member 2 is moved along the guiding member 1 together with the paper web threading member 2 and by way of the aforementioned guide roller GR and turning bar, etc to the final processing section, thereby achieving threading of the paper web along the preselected path. In the paper web threading operation, when the paper web retaining member 2*a* attached to the paper web threading member 2 arrives at a predetermined position in the final processing section, the transmission of the paper web threading member drive signal $S_0$ is cut off, thereby stopping the driving means 5, 5—to stop the movement of the paper web threading member 2.

With the movement of the paper web threading member 2 for making preparations for threading the paper web through the relevant path and for conducting the paper web threading operation, the means for monitoring the movement of the paper web threading member 2 at each of the detection places functions as follows.

Figure 2:
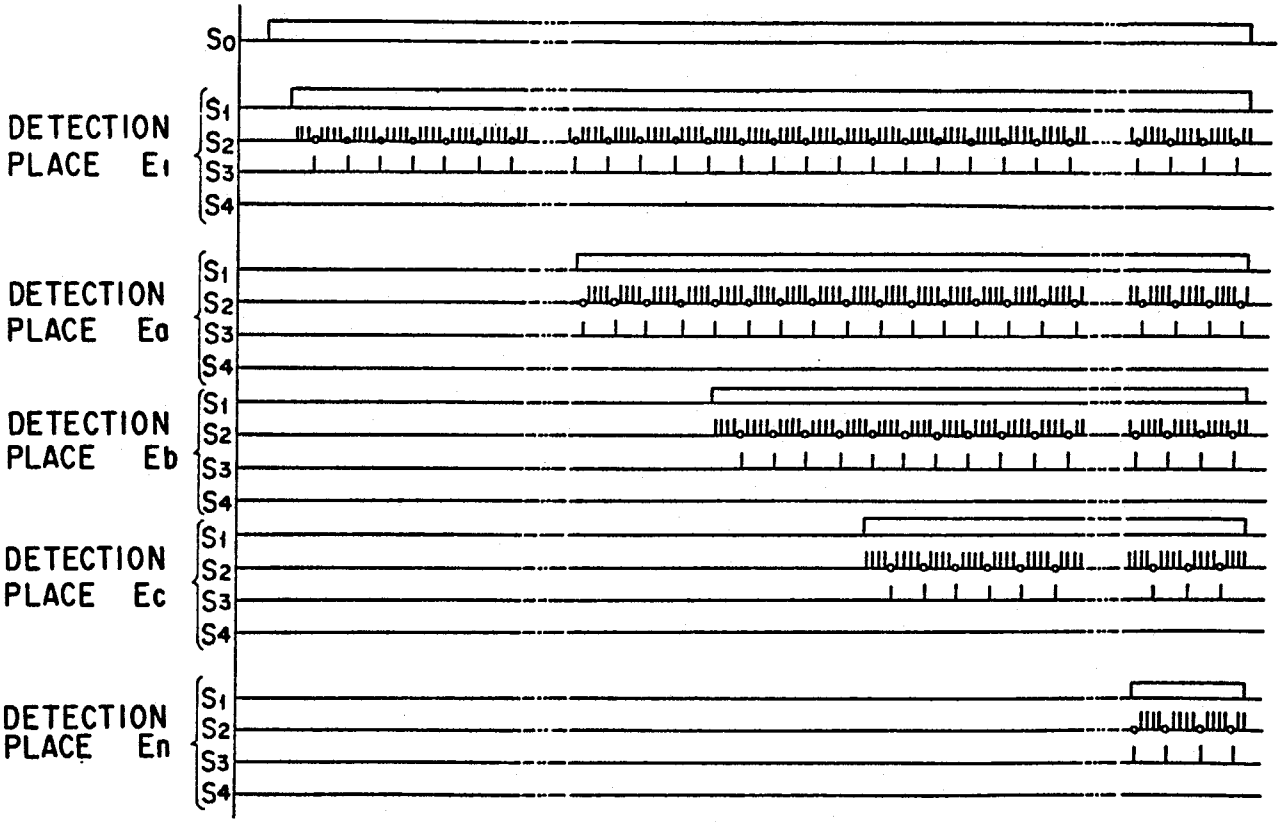
FIG. 2 is a time chart showing the operating conditions of the means provided at each of the detection places when a paper web threading member is moved for making preparations for paper web threading operation in the embodiment shown in FIG. 1.

In the first place, in FIG. 2, in response to the commencement of operation of the driving means 5, 5—by the paper web threading member drive signal $S_0$, the paper web threading member detecting means $6_1$—$6_n$ are rendered operative to detect the paper web threading member 2, which is moved along the guide member 1, through the hole 1*b* and output a signal $S_1$ indicative of the presence of paper web threading member during the passage of the paper web threading member 2 through the hole 1*b* in the guide member 1 after its arrival at the upstream edge of the hole 1*b*.

Upon receipt of the signal $S_1$ indicative of the presence of paper web threading member, any one of the guide piece detecting means $7_1$—*7n* and any one of the the abnormality indication outputting means $8_1$—*8n* provided at any one of the detection places $E_1$—En corresponding to the above-mentioned paper web threading member detecting means are rendered operative, and the timer unit (not shown) of the abnormality indication signal outputting means will commence its time counting. Further, the relevant guide piece detecting means will output a guide piece detection signal $S_3$ each time it detects the guide piece 3 which passes through the detection place with the movement of the paper web threading member 2. The guide piece detection signal $S_3$ will reset the time by the timer unit of the abnormality indication signal outputting means provided at the same detection place as the guide piece detecting means which outputs the signal $S_3$.

Preset to each of the abnormality indication signal outputting means $8_1$—*8n* is a predetermined reference or limit time "t" decided on the basis of the time intervals at which guide pieces 3, 3—are to be detected, in turn, and which is computed from the speed of movement of the paper web threading member 2, that is, the operating speed of each of the driving means 5, 5—, which is nearly proportional to the aforementioned speed of movement when the preparations for the threading of paper web are made or when the paper web is threaded along the relevant path, and the distance between the adjacent guide pieces 3, 3—. At the detection place Eb, for example, after the guide piece detecting means 7*b* which has detected the preceding guide piece 3 outputs a preceding guide piece detection signal $S_3$, if the aforementioned predetermined reference time is reached without detection of the next guide piece 3 by the guide piece detecting means 7*b*, and hence without transmission of the next guide piece detection signal $S_3$, and also without resetting the time counting which is made by the timer of the abnormality indication signal outputting means 8*b*, then the latter will discriminate it as abnormal condition occuring in the movement of the paper web threading member 2 which is passing through the detection place Eb and output an abnormality indication signal $S_4$.

Figure 3:
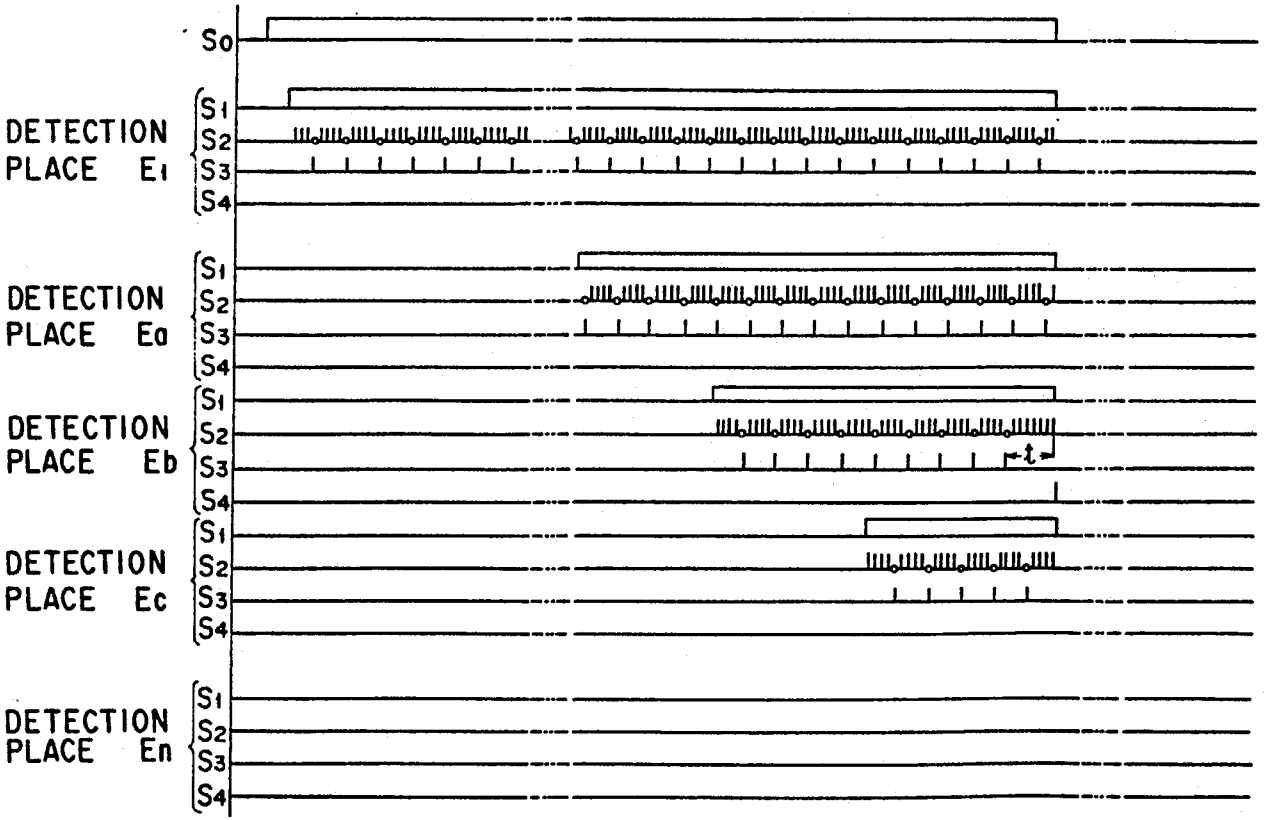
FIG. 3 is a time chart showing the operating conditions of the means provided at each of the detection places when the paper web threading member is moved for making preparations for paper web threading operation in the embodiment shown in FIG. 1, wherein an abnormality indication signals is outputted.
Figure 4:
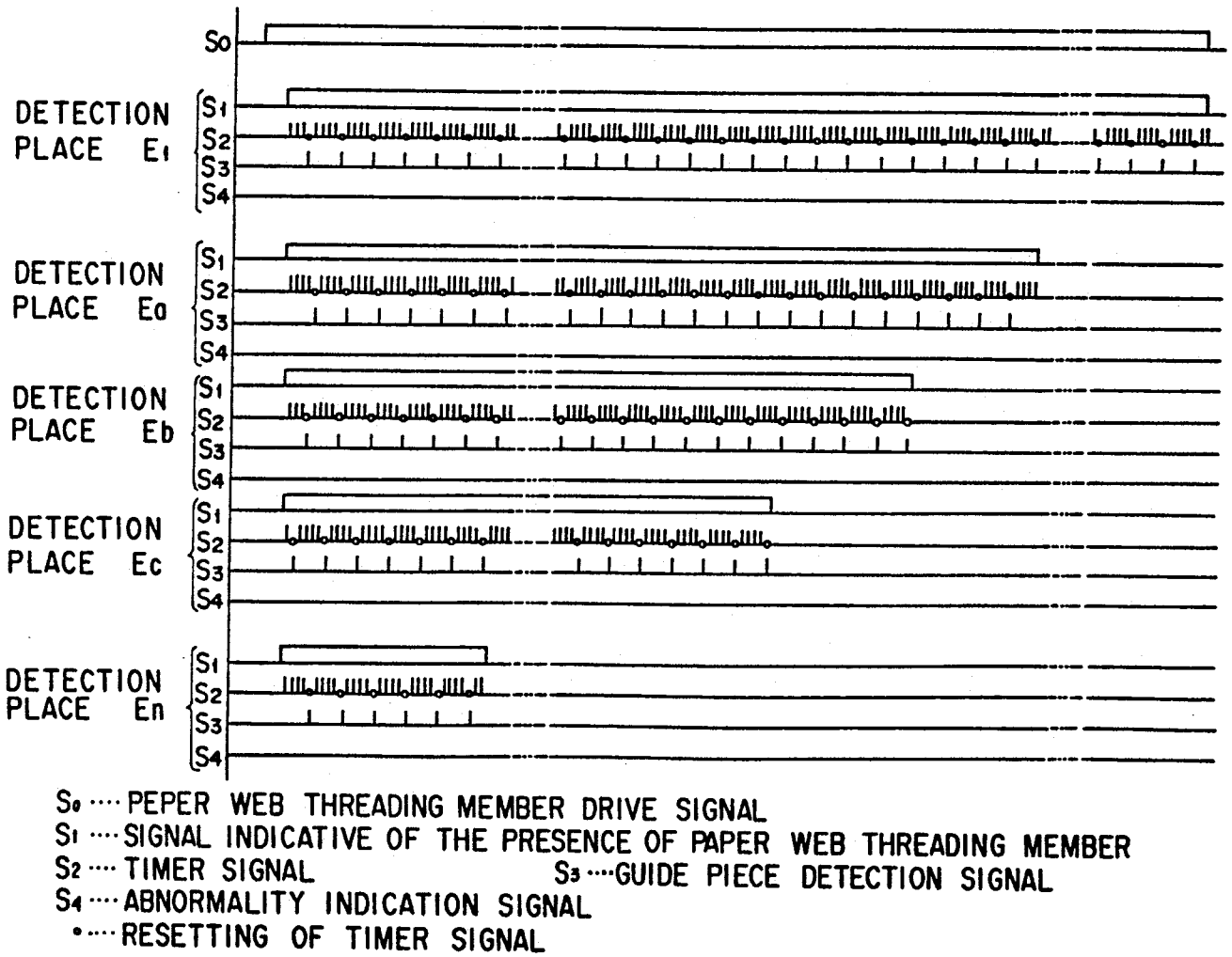
FIG. 4 is a time chart showing the operating conditions of the means provided at each of the detection places when the paper web threading member is moved for threading a paper web through a predetermined paper web threading path in the embodiment shown in FIG. 1.
Figure 5:
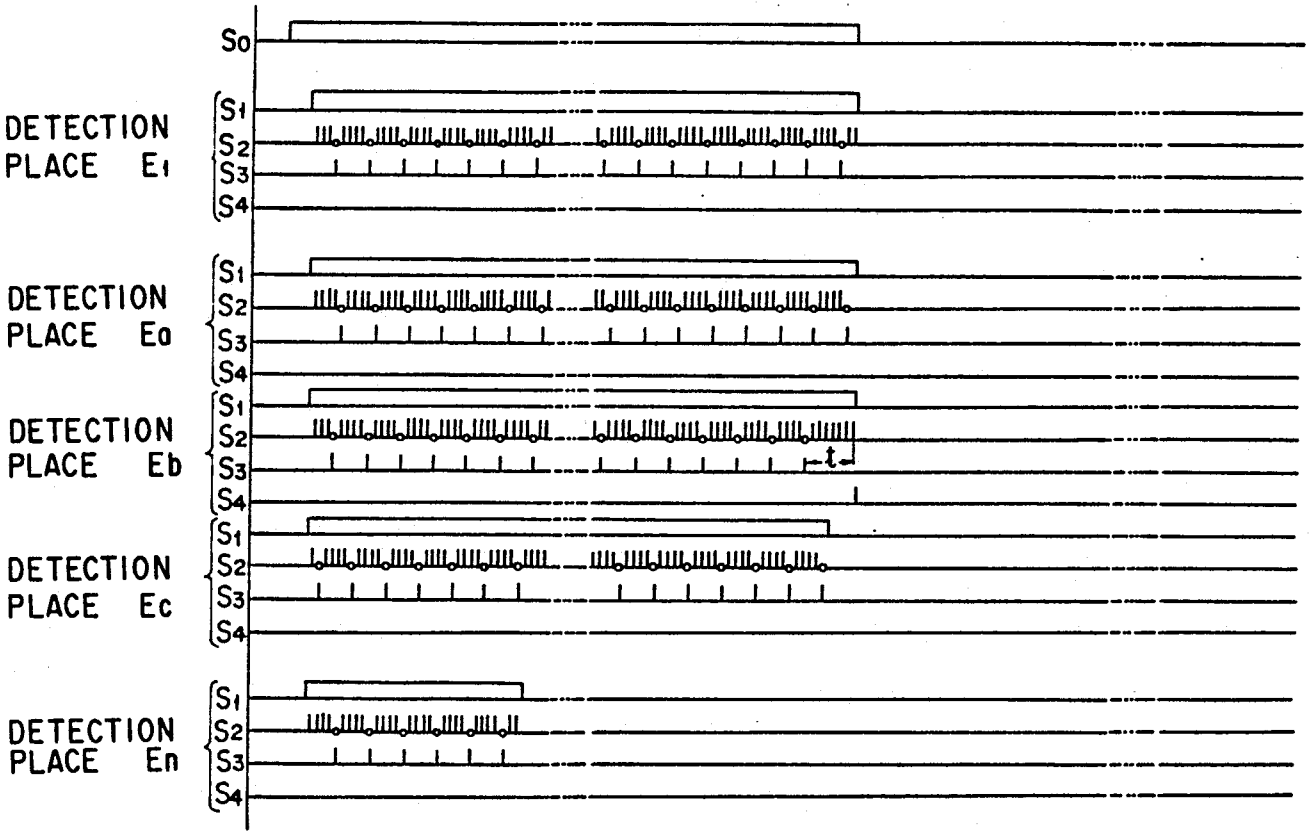
FIG. 5 is a time chart showing the operating condition of the means provided at each of the detection places when the paper web threading member is moved for paper web threading operation in the embodiment shown in FIG. 1, wherein an abnormality indication signal is outputted.

Upon receipt of the abnormality indication signal S4, the drive controlling means 9 will cease from transmitting the paper web threading member drive signal $S_0$ to thereby stop the operation of the driving member 5, 5—, to interrupt the movement of the paper web threading member 2, and also render the paper web threading member detecting means $6_1$—6*n* inoperative, thereby cutting off the signal $S_1$ indicative of the presence of paper web threading member. As a result of the cut-off of the signal $S_1$, the guide piece detecting means $7_1$—7*n* and the abnormality indication signal outputting means $8_1$—8*n* are rendered inoperative. (FIGS. 3 to 5)

When there is no abnormal condition in the movement of the paper web threading member 2, at all the detection places $E_1$—En, the guide piece detecting pieces $7_1$—7*n* detect the guide pieces 3, 3—in turn and output guide piece detection signals $S_3$, and the time counting by the timer unit of each of the abnormality indication signal outputting means $8_1$—8*n* is reset in turn within the predetermined limit time, so that no abnormality indication signal S4 is outputted. (refer to FIGS. 2 and 4)

As a result, the paper web threading member 2 is moved continuously, and when one end of the paper web threading member 2 arrives at a predetermined position in the paper supply section or the final processing section, a stop signal is outputted by an appropriate detector means, not shown. Consequently, all the driving means 5, 5—are stopped, and all of the paper web threading member detecting means $6_1$—6*n*, the guide piece detecting means $7_1$—7*n* and the abnormality indication signal outputting means $8_1$—8*n* are rendered inoperative, thereby completing the preparation for the threading of the paper web through the relevant path or the paper web threading operation.

Further, in FIG. 1, reference character "A" shows an arrangement for drawing out the paper web W from the paper web take-up reel WR and threading it along the relevant paper web threading path, and reference character "B" indicates an arrangement for threading one of the web stripes obtained by slitting the paper web W by a slitter SL along its path. Reference character "Z" indicates a retaining means for retaining one of the divided web strips to the paper web retaining member 2*a* of the paper web threading member 2.

Figure 6:
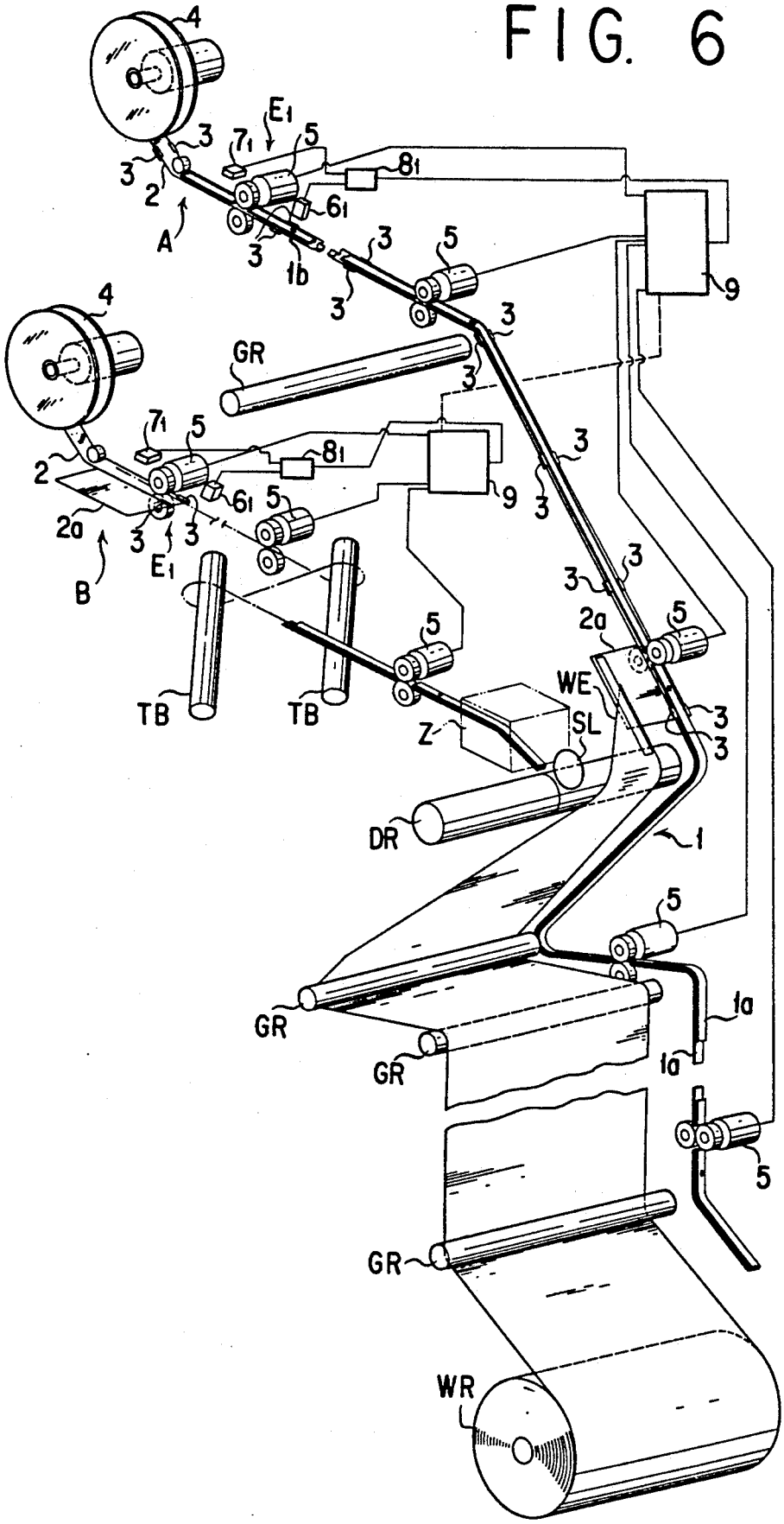
FIG. 6 is a schematic overall configurational view showing the second embodiment of the present invention.
Figure 7:
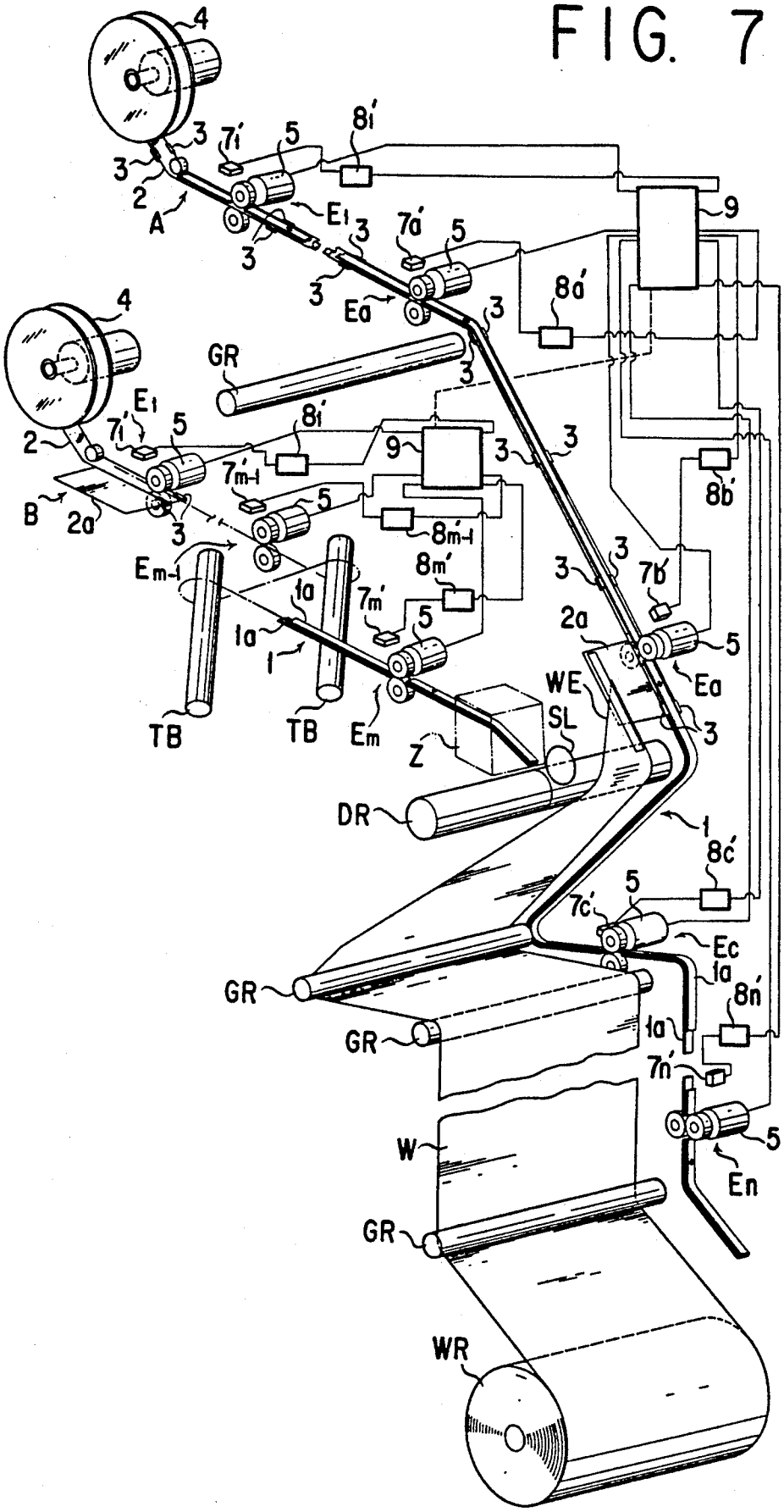
FIG. 7 is a schematic overall configurational view showing the third embodiment of the present invention.

FIGS. 6 and 7 show further embodiments of the present invention which differ form the embodiment shown in FIG. 1 in the arrangement of the detection places and/or the construction of the means for monitoring the movement of the paper web threading member 2 provided at the detection places. The differences of the embodiments shown in FIGS. 6 and 7 from that shown in FIG. 1 will be described below. Further, throughout the embodiments shown in FIGS. 1, 6 and 7, the component parts having the same function are denoted by the same reference numeral. The embodiment shown in FIG. 6 differs from that shown in FIG. 1 in that the number of the detection places is reduced to only one, and is effective for detection of abnormal condition which may occur during the movement of the paper web threading member 2 for drawing it out from the paper web threading member pooling section 4 and also during the movement of the paper web threading member 2 for pulling it back to the section 4.

A detection place $E_1$ is set in the vicinity of the paper web threading member pooling section 4. At the detection place $E_1$, there are installed a paper web threading member detecting means $6_1$ and a guide piece detecting means $7_1$ which have the same functions as those in the embodiment shown in FIG. 1. Further, an abnormality indication signal outputting means $8_1$ is installed, and is connected with these means $6_1$ and $7_1$, respectively.

In the above-mentioned arrangement, the paper web threading member detecting means $6_1$, the guide piece detecting means $7_1$ and the abnormality indication signal outputting means $8_1$ serve to detect whether or not there is abnormal condition in the movement of the paper web threading member 2 by the same functions as those described with reference to the embodiment shown in FIG. 1.

The difference between the embodiments shown in FIGS. 1 and 6 resides in that, in the embodiment shown in FIG. 1, the location of one end of the paper web threading member 2 along the guide member 1 when an abnormal condition occurs in the movement of the paper web threading member 2 can be detected readily by appropriately processing and utilizing the signal indicative of the presence of the paper web threading member, which is transmitted by the paper web threading member detecting means.

The embodiment shown in FIG. 7 differs from that shown in FIG. 1 in that the paper web threading member detecting means $6_1$—6*n* arranged at all the detection places $E_1$—En as shown in FIG. 1 are eliminated, and is effective for detection of abnormal condition which may occur during the movement of the paper web threading member 2 for drawing it out from the paper web threading member pooling section 4.

In the above-mentioned arrangement, each of the guide piece detecting means $7_1'$—7*n*' provided at the detection places $E_1$—En, respectively, is rendered operative by the paper web threading member drive signal $S_0$, and each of the abnormality indication signal outputting means $8_1'$—8*n*' which are connected with the detecting means $7_1'$—7*n*' receives a guide piece detection signal $S_3$ from the corresponding guide piece detecting means and is rendered operative to commence its time counting. And, the time counting is reset by a guide piece detection signal $S_3$ which is outputted by the guide piece detecting means immediately thereafter. The behavior wherein an abnormality indication signal is outputted by any one of the abnormality indication signal outputting means $8_1'$—8*n*' is the same as that in the embodiment shown in FIG. 1. The difference between the embodiments shown in FIGS. 1 and 7 resides in that, in the embodiment shown in FIG. 1, after the paper web threading member 2 has passed through each of the detection places $E_1$—En, the guide piece detecting means and the abnormality indication signal outputting means connected therewith at that detection place are rendered off or inoperative, whilst in the embodiment shown in FIG. 7, the abnormality indication signal outputting which has once been rendered on or operative is not rendered off unless an appropriate stop signal is outputted.

Figure 8:
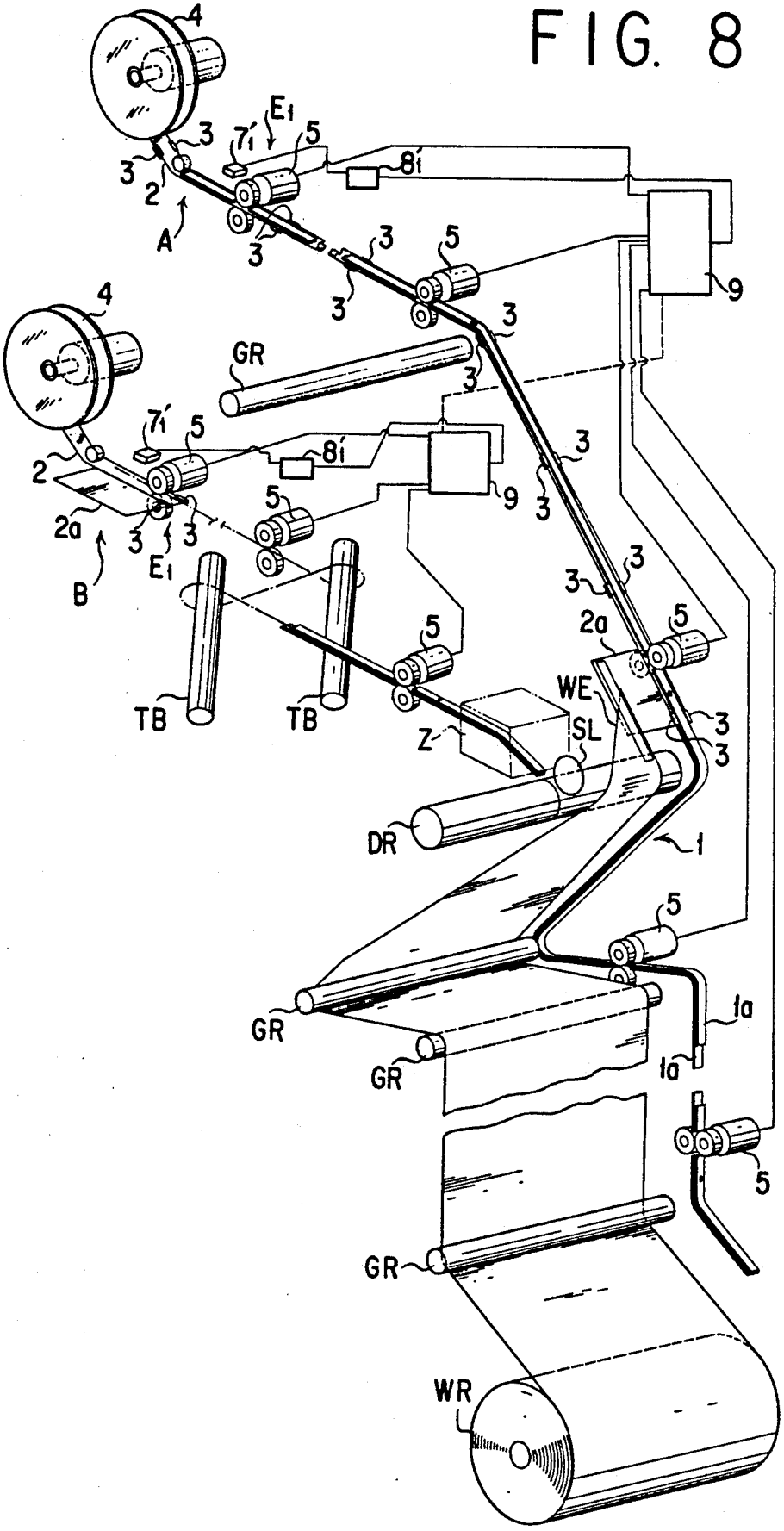
FIG. 8 is a schematic overall configurational view showing the fourth embodiment of the present invention.

The embodiment shown in FIG. 8 differs from that shown in FIG. 7 in that the number of the detection places $E_1$—En is reduced to only one, and is effective for detection of abnormal condition which might occur during the movement of the paper web threading member 2 for drawing it out from the paper web threading member pooling section 4 and also during the movement of the paper web threading member 2 for drawing it back to the section 4.

A detection place $E_1$ is set near the paper web threading member pooling section 4. At the detection place $E_1$, there is provided a guide piece detecting means $7_1'$ which has the same function as that in the embodiment shown in FIG. 7. And, an abnormality indication signal outputting means $8_1'$ is provided and connected with the guide piece detecting means $7_1'$.

In the above-mentioned arrangement, the guide piece detecting means $7_1'$ and the abnormality indication signal outputting means $8_1'$ serve to detect whether or not there is any abnormal condition in the movement of the paper web threading member 2 by the same functions as those described with reference to the embodiment shown in FIG. 7.

The difference between the embodiments shown in FIGS. 7 and 8 resides in that, in the embodiment shown in FIG. 7, the location of one end of the paper web threading member along the guide member 1 when an abnormal condition occurs in the movement of the paper web threading member 2 can be detected readily by appropriately processing and utilizing the on-state signal transmitted by the abnormality indication signal outputting means, while in the embodiment shown in FIG. 8, since only one detection place $E_1$ is provided near the paper web threading member pooling section 4, during the movement of the paper web threading member 2 for drawing it out from the paper web threading member pooling section 4 and also during the movement of the paper web threading member for pulling it back to the section 4, the guide piece detecting means $7_1'$ can continuously detect the guide pieces 3, 3—of the paper web threading member 2 so that even during the movement of the paper web threading member 2 for drawing it back to the paper web threading member pooling section 4 it can be detected whether or not there is any abnormal condition in the movement of the paper web threading member 2.

Figure 9:
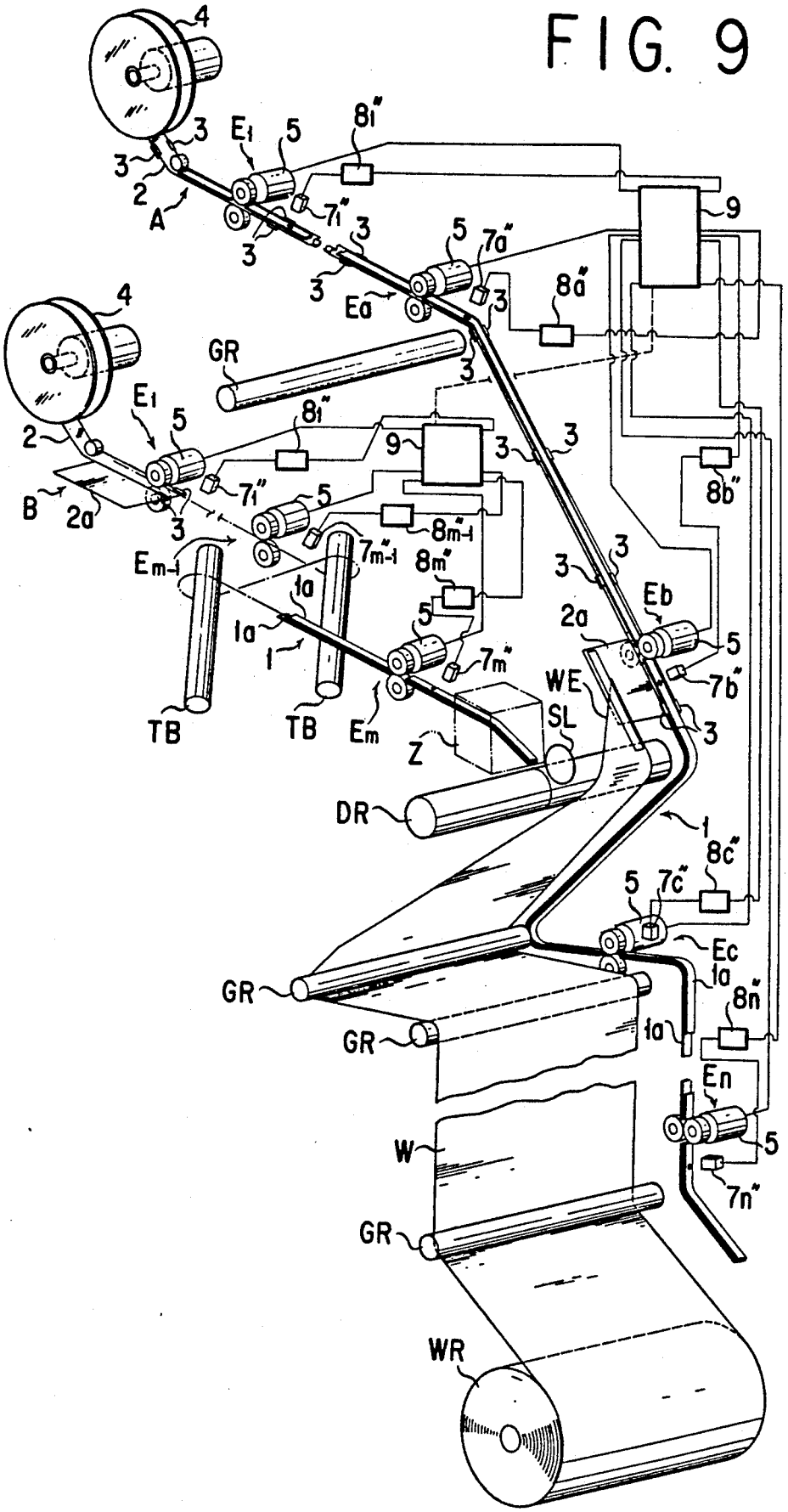
FIG. 9 is a schematic overall configurational view showing the fifth embodiemnt of the present invention.

The embodiment shown in FIG. 9 is arranged such that, though a plurality of guide pieces are arranged at intervals in the longitudinal direction of the paper web threading member 2, only the leading end of the paper web threading member 2 serves as the portion to be detected, and the passage of the leading end is detected by each of the detecting means $7_1''$—$7n''$ through each of the holes 1*b* formed in the rail member 1*a* at each of the detection places $E_1$—En spaced apart in the longitudinal direction of the guide member 1, and a detection signal $S_3$ is outputted by the detecting means. Further, abnormality indication signal outputting means $8_1''$—$8n''$ are provied at the detection places $E_1$—En, respecitvely, and connected with the guide piece detecting means $7_1''$—$7n''$, respectively. Each of the abnormality indication signal outputting means $8_1''$—$8n''$ is connected with the guide piece detecting means which are provided at that detection place and adjacent upstream and downstream detection places, respectively.

For example, the abnormality indication signal outputting means 8*b*'' is connected with the guide piece detecting means 7*b*'', 7*a*'' and 7*c*'' provided at the detection place Eb and adjacent detection places Ea and Ec, respectively. (To avoid the drawing from becoming complicated, the connection of the abnormality indication signal outputting means 8*b*'' with the detector means 7*a*'' and 7*c*'', respectively, is not shown) The arrangement is made such that, during the movement of the paper web threading member 2 for threading the paper web along the relevant path, the abnormality indication signal outputting means 8*b*'' is rendered operative by a guide piece detection signal $S_3$ which is outputted by the guide piece detecting means 7*c*'' provided at the detection place Ec set on the upstream side of the direction of movement of the paper web threading member 2 to thereby commence time counting, and stops the time counting when it receives a guide piece detection signal $S_3$ which is outputted by the guide piece detecting means 7*b*'' provided at the same detection place Eb.

In the above-mentioned arrangement, the time required for the paper web threading member 2 to move between the adjacent ones of the detection places $E_1$—En is computed from the distance between the adjacent ones of the holes 1*b* formed in the rail member 1*a* and the speed of operation of the driving means 5, 5—, and a predetermined reference or limit time is decided by the value thus obtained, and such reference time is set in each of the abnormality indication signal outputting means $8_1''$—$8n''$.

In such an arrangement, after the paper web threading member 2 begins to move along the guide member 1, if the time counting by any one of the abnormality indication signal outputting means $8_1''$—$8n''$ is not stopped in the predetermined reference time, then the relevant abnormality indication signal outputting means will discriminate it as abnormal condition occuring in the movement of the paper web threading member 2 and output an abnormality indication signal $S_4$.

The embodiment shown in FIG. 9 is effective for detection of abnormal condition during the movement of the paper web threading member 2 for drawing it out from the paper web threading member pooling section 4 and also during the movement of the paper web threading member 2 to the section 4. However, in order to achieve the same abnormality detection accuracy as that in the embodiment shown in FIG. 1, the spacing between the detection places is required to be kept equal to the distance between the guide pieces 3 of the embodiment shown in FIG. 1.

Further, the final resetting of the timer unit of each of the abnormality indication signal outputting means in each of the above-mentioned embodiments is made according to an appropriate timing from the time when an abnormality indication signal is outputted to the time when the next operation is commenced.

While the present invention has been described hereinabove by way of several embodiment, it is not to be limited to the above-mentioned embodiments, and, for example, the paper web threading member may be formed in an appropriate shape and in an appropriate length, and the ends of the paper web threading member may be located within the length of the guide member during the movement thereof. The portions to be detected may be of any appropriate form, and it is neither necessary to provide a plurality of portions to be detected along the whole length of the paper web threading member nor locate them substantially at regular intervals along the latter. However, in case both ends of the paper web threading member are located within the guide member during the movement thereof, or in case a plurality of portions to be detected are not provided along the whole length of the paper web threading member, it is of course necessary to take proper measures for appropriately rendering the abnormality indication signal outputting means inoperative, such as, for example, presetting the number of times of resetting of time counting at each abnormality indication signal outputting means, presetting the duration of on-state of each abnormality indication signal outputting means or the like. In case the spaces between the adjacent portions to be detected are not nearly equal, the predetermined reference or limit time may be preset taking into account the maximum distance between the adjacent portions to be detected.

Further, it is not necessary to limit the location of the paper web threading member pooling section only on the side of the final processing section, and also the paper web threading member pooling section may be dispensed with.

Further, the detecting means for detecting the portion or portions to be detected may be of such a configuration as detecting means such as, for example, an aperture or a lens provided at each of detection places is connected with a transmitter spaced apart from the detecting means by an appropriate means such as, for example, an optical fibre cable or the like. In case this configuration is applied to a paper web threading apparatus constructed such that at least one portion to be detected provided on the paper web threading member is detected in turn at a plurality of detection places along the guide member, a plurality of detecting means may be connected with one piece of transmitter. In this case, however, the timer unit of the abnormality indication signal outputting means connected with that transmitter begins its time counting when it receives a detection signal transmitted by a first detecting means connected with the transmitter, and the time counting is reset by a detection signal transmitted by a second detecting means, and finally the time counting is stopped by a detection signal transmitted by a third detecting means.

Still further, in place of the operation of interrupting the above-mentioned paper web threading member drive signal or in addition to the same, an abnormality indication signal may be informed to operators concerned by means of an alarm (not shown).

It is to be understood that the foregoing description is merely illustrative of preferred embodiments of the present invention, and that the scope of the invention is not limited thereto, but is to be determined by the scope of the appended claims. Various changes and modifications may be made in the design thereof without departing from the spirit or scope of the claims.

What is claimed is:

1. A paper web threading apparatus for use in a paper web processing machine, comprising:

a guide member provided along a paper web threading path;

a paper web threading member to which a paper web is secured which is moved along the guide member so as to thread the paper web through the paper web threading path, said paper web threading member having at least a portion to be detected provided thereon;

a plurality of threading member detecting means, provided along said paper web threading path, for detecting the paper web threading member which is moved along the guide member and for outputting a detection signal ($S_1$);

a plurality of abnormality indication signal outputting means, provided along said paper web threading path, for outputting an abnormality indication signal ($S_2$) when the detection signal ($S_1$) is not outputted from said threading member detecting means within a predetermined period of time during the movement of said paper web threading member, at least one of said plurality of abnormality indication signal outputting means being operably coupled to at least a corresponding one of said plurality of threading member detecting means, and being operable when said at least a corresponding one of said plurality of threading member detecting means outputs said detection signal ($S_1$), wherein said predetermined period of time is determined by a movement speed of said paper web threading member and a distance between adjacent portions of said paper web threading member to be detected; and guide pieces attached to said paper web threading member, and at least one guide piece detecting means, operably coupled to at least a corresponding one of said plurality of threading member detecting means, for detecting said guide pieces and for outputting a guide piece detection signal ($S_3$) only while said detection signal ($S_1$) is outputted.

2. A paper web threading apparatus for use in a paper web processing machine according to claim 1, wherein said paper web threading member has at least one portion to be detected provided thereon, and the portion to be detected is detected by means of said threading member detecting means.

3. A paper web threading apparatus for use in a paper web processing machine according to claim 1, wherein one portion to be detected provided on the paper web threading member is detected at a plurality of detection places disposed at intervals of a predetermined distance along the guide member.

4. A paper web threading apparatus for use in a paper web processing machine according to claim 1, wherein the paper web threading member has a plurality of portions to be detected provided in the longitudinal direction thereof, and these portions to be detected are detected at one detection place disposed in the vicinity of the guide member.

5. A paper web threading apparatus for use in a paper web processing machine according to claim 4, further comprising paper web threading member detecting means capable of detecting the paper web threading member itself which is provided at the detection place for detecting the portions to be detected provided on the paper web threading member, wherein only at the detection place where the paper web threading member detecting means is detecting the paper web threading member, the abnormality indication signal ($S_2$) outputting means is rendered operative.

6. A paper web threading apparatus for use in a paper web processing machine according to claim 1, wherein the paper web threading member has a plurality of portions to be detected provided at intervals of a predetermined distance in the longitudinal direction thereof, and these portions to be detected are detected at a plurality of detection places disposed at intervals of a predetermined distance along the guide member, and also an abnormality indication signal ($S_2$) is outputted when the detection signal ($S_1$) is not outputted from any one of the detection places within a predetermined period of time.

7. A paper web threading apparatus for use in a paper web processing machine according to claim 6, further comprising paper web threading member detecting means capable of detecting the paper web threading member itself which is provided at the detection places for detecting the portions to be detected provided on the paper web threading member, wherein only at the detection place where the paper web threading member detecting means is detecting the paper web threading member, the abnormality indication signal outputting means is rendered operative.

8. A paper web threading apparatus for use in a paper web processing machine according to claim 1, wherein said movement speed of said paper web threading member is substantially proportional to a movement speed of said paper web threading member during a threading preparation of said paper web.

9. A paper web threading apparatus for use in a paper web processing machine according to claim 1, wherein said movement speed of said paper web threading member is substantially proportional to a movement speed of said paper web threading member during a threading of said paper web through said paper web threading path.

10. A paper web threading apparatus for use in a paper web processing machine, comprising:

a guide member provided along a paper web threading path;

a paper web threading member to which a paper web is secured which is moved along the guide member so as to thread the paper web through the paper web threading path, said paper web threading member having at least a portion to be detected provided thereon;

a plurality of threading member detecting means, provided along said paper web threading path, for detecting the paper web threading member which is moved along the guide member and for outputting a detection signal ($S_1$);

a plurality of abnormality indication signal outputting means, provided along said paper web threading path, for outputting an abnormality indication signal ($S_2$) when the detection signal ($S_1$) is not outputted from said threading member detecting means within a predetermined period of time during the movement of said paper web threading member, at least one of said plurality of abnormality indication signal outputting means being operably coupled to at least a corresponding one of said plurality of threading member detecting means, and being operable when said at least a corresponding one of said plurality of threading member detecting means outputs said detection signal ($S_1$), wherein said predetermined period of time is determined by a movement speed of said paper web threading member and a distance between adjacent portions of said paper web threading member to be detected; and guide pieces attached to said paper web threading member, and at least one guide piece detecting means, operably coupled to at least a corresponding one of said plurality of threading member detecting means, for detecting said guide pieces and for outputting a guide piece detection signal ($S_3$) only while said detection signal ($S_1$) is outputted, wherein said guide piece detecting means operates only while said signal ($S_1$) indicative of a presence of said paper web threading member is outputted, wherein said guide piece detecting means detects said guide pieces of said paper web threading member which is moved along said guide member and outputs said guide piece detection signal ($S_3$), wherein each of said plurality of abnormality indication signal outputting means incudes a timer unit and operates only while said signal ($S_1$) indicative of the presence of said paper web threading member is outputted, wherein each of said abnormality indication signal outputting means transmits a timer signal when said abnormality indication signal outputting means operates, wherein said timer unit conducts a time count upon receipt of said timer signal, and wherein said timer unit is reset upon receipt of said guide piece detection signal ($S_3$).

* * * * *